US005486685A

United States Patent [19]

Dodds

[11] Patent Number: 5,486,685

[45] Date of Patent: Jan. 23, 1996

[54] OVEN WITH FOOD PRESENCE INDICATOR

[76] Inventor: W. Jean Dodds, 938 Stanford, Santa Monica, Calif. 90403

[21] Appl. No.: 344,276

[22] Filed: Nov. 23, 1994

[51] Int. Cl.[6] ..... H05B 6/68

[52] U.S. Cl. ..... 219/720; 219/506; 219/518; 219/708; 219/706; 99/325

[58] Field of Search ..... 219/720, 708, 219/702, 705, 704, 706, 709, 716, 719, 518, 506; 99/325

[56] References Cited

U.S. PATENT DOCUMENTS

| | | | |
|---|---|---|---|
| 3,300,615 | 1/1967 | Smith | 219/708 |
| 4,650,970 | 3/1987 | Ohouchi | 219/720 |
| 4,724,292 | 2/1988 | Ichikawa | 219/708 |
| 4,833,304 | 5/1989 | Ueda | 219/706 |

FOREIGN PATENT DOCUMENTS

| | | | |
|---|---|---|---|
| 3704002 | 8/1988 | Germany | 219/720 |
| 6-181520 | 9/1985 | Japan | 219/704 |
| 63-150525 | 6/1988 | Japan | 219/704 |
| 2-101325 | 4/1990 | Japan | 219/720 |
| 5-240442 | 9/1993 | Japan | 219/720 |

*Primary Examiner*—Philip H. Leung
*Attorney, Agent, or Firm*—Merchant, Gould, Smith, Edell, Welter & Schmidt

[57] ABSTRACT

An oven includes a chamber for locating food for heating. An indicator is provided for signalling the existence of food in the chamber. A sensor may react to the weight of the food on a support in the chamber, or a light beam directed in the chamber and interrupted by a food or receptacle for thereby indicating the existence of food. A time delay may be provided between the sensing of the existence of food and the activation of the indicator. In other situations the indicator system operates in other ovens, autoclaves, and furnaces having workpieces for science, technology, and industry.

13 Claims, 1 Drawing Sheet

OVEN WITH FOOD PRESENCE INDICATOR

BACKGROUND

An oven having indicator means to avoid food spoilage is highly desirable. This invention relates to ovens, particularly microwave ovens.

The invention is also directed to ovens generally where is desirable to have indicator means to regulate a situation of the oven to minimize the possibility of spoilage or damage to the contents. As such the invention is also directed to autoclaves and ovens for science and technology in laboratories and industry, and furnaces and the like for crafts such as pottery.

It is known to have microwave ovens and convection ovens which have different indicator means. In particular, such indicator means indicate by light or sound when a cooking period is complete.

Other situations arise where indicating the state of the condition of the food in the oven is desirable. For instance, food may be in an oven frozen, thawing, uncooked, partially cooked or cooked. In error or through oversight, such food may not be removed from the oven before the food can become spoiled.

There is a need to provide an oven with a novel indicator means for conditions which are not currently addressed by existing indicators or alarms.

SUMMARY

According to the invention, there is provided an oven which seeks to minimize the disadvantages of known ovens using different indicators or alarms.

An oven comprises a chamber wherein food can be received for heating or defrosting. There is a door to the chamber, the door being normally closed to thereby provide a closed chamber in which heating or defrosting of the food can be effected. Means is provided for generating heat in the chamber or in the food in the chamber. There is a support in the chamber for locating the food or a receptacle for food in the chamber. A sensor is provided for indicating the existence of food on the support. The activation of the sensor can cause the indicating means to signal by sound or light the existence of food on the support, which is a turntable, shelf, base or the like in the oven.

In some preferred forms of the invention, a timer is operable with the indicator whereby the indicator is activated only after a predetermined time delay.

The sensor may be operable by determination of weight on the support means for the food. Alternatively or additionally, means is provided for generating a light beam in the chamber, interruption of the beam between a light source and a light receiver indicating the existence of food and/or a receptacle for food in the chamber thereby activating the indicator or an alarm.

The invention is further described with reference to the accompanying drawings.

DRAWINGS

DESCRIPTION

Figure 1:
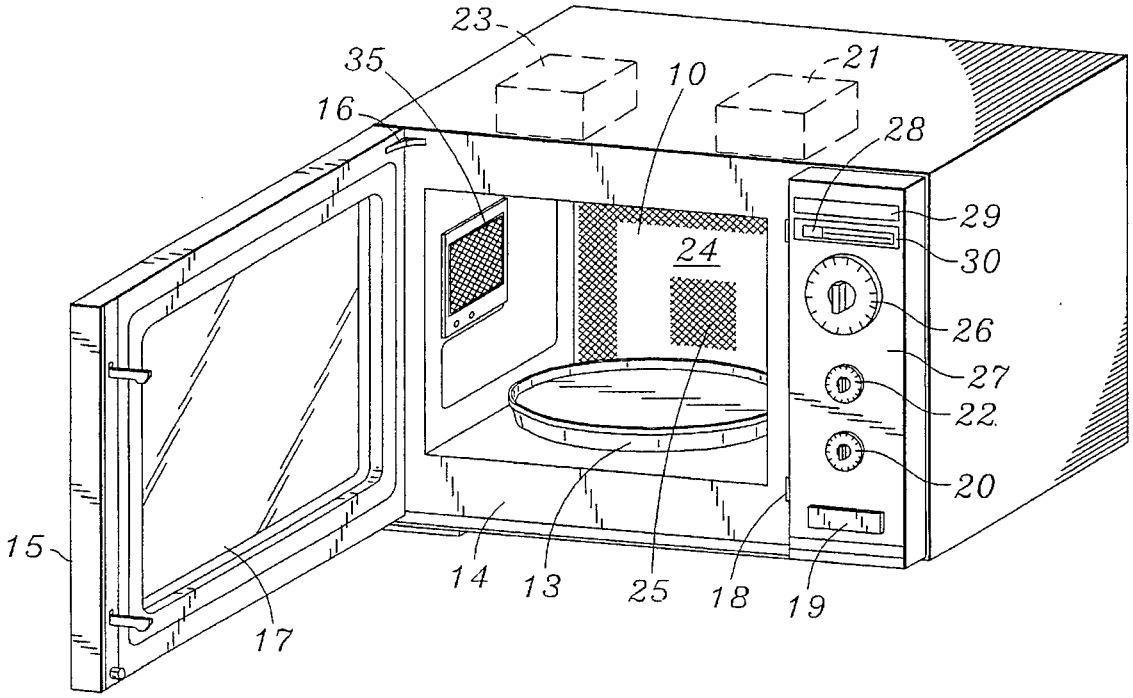
FIG. 1 is a perspective view of a microwave oven with the door to the heating chamber open.

A chamber 10 is provided for heating food 11 in a receptacle 12 which is located on a support which is a turntable 13. The turntable 13 can rotate clockwise or counterclockwise under the action of a motor located in the base 14 to the microwave oven.

An oven door 15 is mounted on a hinge 16 and has a see-through window 17, which is normally opaque to the outside. Latches 18 are provided to facilitate closing of the door to the chamber. The oven will not operate unless the door 15 is securely closed with the latches 18.

A start button 19 is located in a panel adjacent to the chamber 10. A variable cooking control 20 is provided for setting the degree of power to be supplied by a microwave generating element 21 which is diagrammatically illustrated above the chamber 10. The generator 21 can be located at any suitable place relative to the chamber 10.

There is also provided a convection oven temperature control 22 for regulating the temperature to be set in the chamber 10 in response to the operation of a heating generator 23. The heating generator 23 is diagrammatically illustrated also at the top of the chamber 10. The heating element can be located effectively at a different position in the body of the oven relative to the chamber 10. Heat would be blown into the chamber through the rear wall 24 and in particular through a grill 25 in the rear of the chamber 10.

A timer 26 for both the microwave and convection cooking is provided on the side panel 27 adjacent to the chamber 10. A switch 28 in the panel 27 selectively chooses between microwave cooking and convection cooking. An indicator 29 is provided at the top of the panel 27 for indicating the existence of food 11 or receptacle 12 for food on the turntable 13. The indicator or alarm 29 is a light panel. Alternatively or additionally there can be included a buzzer or other sound generating device, such as a beeper or ringer, for indicating an audio signal. A timer element 30 can be used to set or disable the indicator 29 as required.

Weight sensing means includes a weight sensor device 31 located below the turntable 13 is responsive to the weight of receptacle 12 and/or food 11 in the receptacle 120 Thus, when a weight or pressure is measured by the sensor 31 which is more than a predetermined amount, a signal is sent along line 32 to activate the indicator means 29. If the timer 30 is operational, the indicator 29 can be delayed and its operation can be enabled after a predetermined time.

Figure 2:
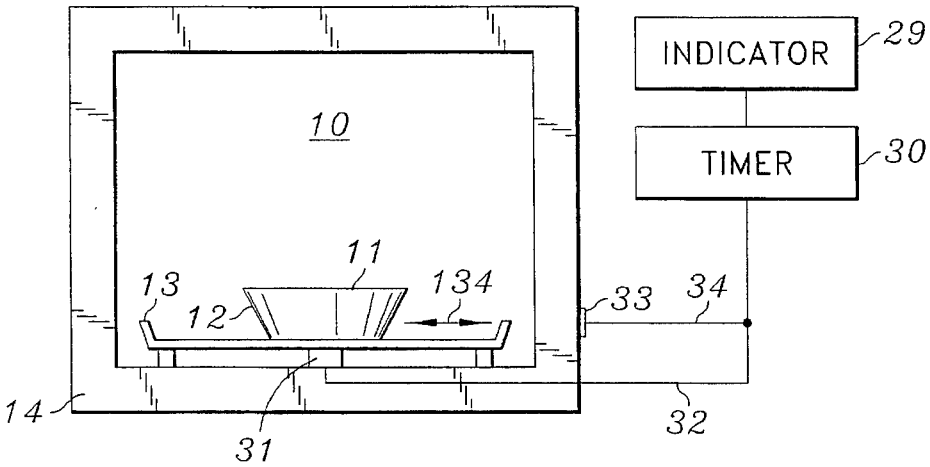
FIG. 2 is a diagrammatic front view of a chamber with food in a receptacle in the chamber, and a timer and indicator means associated with the chamber.

Additionally or alternatively there is provided a light beam signalling source which emits light beams, such as infrared, laser light at a predetermined wavelength or other light along a path 134 as indicated in FIG. 2. There is also a light receiver as part of the source/receiver element 33. If the light beam is interrupted by the existence of the receptacle 12 or food 11, then a specific signal is received by the receiver portion of the light source/receiver 33. The signal is passed along line 34 to the timer 30 and indicator 29. The specific signal would be different to the signal that would be normally transmitted between the source/receiver 33.

The light source/receiver 33 can operate independently and without the weight sensor 31. Alternatively, the weight sensor 31 can operate independently of the light source/receiver 33.

With the system of the invention, the oven can operate to indicate when a food load or receptacle for food is located in the oven. In this manner, after the door 15 is closed a signal is provided on the indicator 29 indicating the existence of food in the oven. Normally, the see-through window 29 is opaque to viewing the contents of the oven except when a light 35 is operational. Such light 35 would illuminate the contents of the chamber when the oven is operational. Normally the light 35 is in an "off" state. Thus, if there is food located in the oven without the oven being operational, it is possible that users may forget the existence of food in the chamber 10. This can result in food spoilage which may only be located the next time the oven is operational. This may be the following day.

With the invention, the provision of the indicator means essentially avoids the likelihood that food can be inadvertently left in the oven. By signalling with the indicator either visually or audibly or with both means, after selected time intervals as required or intermittently as required, it is possible to ensure that inadvertent leaving of food in the oven is avoided.

The weight sensing means 31 is a suitable pressure transducer responsive to the pressure or weight on the element by weight on the support 13. The light beam source and receiver 33 is a suitable device for emitting a light and appropriate wavelength into the chamber 10.

Many other forms of the invention exist, each differing from others in matters of detail only. For instance, instead of a source and receiver at one side of the chamber, it is possible to have the source on one side of the chamber and the receiver on an opposite side.

Although the invention has been described with reference to a microwave oven and convection oven in a combination, the system could work with a microwave oven and convection oven separately.

The invention also operates with a conventional oven as part of a cooking range, wherein an appropriate contents sensor is located relative to a support or shelf in the heating chamber. It would be particularly useful since often cooking ranges have solid metal doors so that after food is located in the oven it is easy to forget that it is there.

While the invention is described as having a support for food in the chamber, it should be understood that the support could be the base or floor for the chamber.

In other forms of the oven the invention has application with autoclaves for science, technology and industry, particularly where precise conditions need to be applied to objects which are placed in the oven. In some industrial uses the objects or contents of the oven need to be heated for a long periods of time, sometimes overnight at precise temperatures, which are often high or critical. Because of this and the need to indicate that the oven has contents, it is particularly useful to use the indicator to signal the presence of contents in the oven.

Also in firing pottery and in performing other crafts it is particularly useful to have an indicator for signalling the presence of a work piece in the oven which is in the nature of a furnace.

What is claimed is:

1. Apparatus for preventing the spoilage of food in an oven, in combination with an oven which includes a chamber within which there are means for receiving food for heating, a door to the chamber, the door being normally closed thereby providing for closure of the chamber in which the heating is effected, means for regular operation for generating heat in the chamber or in food in the chamber, a support in the chamber for locating the food in the chamber, and an indicator for signalling the existence of food in the chamber, comprising means for having the indicator be operational after the regular operation of the means for generating heat in the chamber or in the food, and when the heat-generating means is non-operating including a sensor, the sensor being sensitive to weight, and wherein a weight greater than a predetermined amount activates the indicator, the indicator being selectively at least one of light means or audio means.

2. Apparatus as claimed in claim 1, including a timer, the timer acting to delay operation of the indicator for a predetermined time.

3. Apparatus as claimed in claim 2, wherein the sensor means includes a beam signalling source and receiver, and wherein interference in the beam indicates the existence of food in the oven.

4. Apparatus as claimed in claim 2, including a source for generating microwaves, such that the microwaves are generated into the chamber thereby to heat food located in the chamber, and wherein the oven is a microwave oven.

5. Apparatus as claimed in claim 2, including means to generate heat in the chamber, the oven being a convection oven, the heat being generated by heating element, and including means for generating a flow of heat in the chamber.

6. Apparatus as claimed in claim 1, wherein the sensor means includes a beam signalling source and receiver, and wherein interference in the beam indicates the existence of food in the oven.

7. Apparatus as claimed in claim 1, including a source for generating microwaves, such that the microwaves are generated into the chamber thereby to heat food located in the chamber, and wherein the oven is a microwave oven.

8. Apparatus as claimed in claim 1 including means to generate heat in the chamber, the oven being a convection oven, the heat being generated by heating element, and including means for generating a flow of heat in the chamber.

9. Apparatus for preventing the spoilage of food in an oven, in combination with an oven which includes a chamber within which there are means for receiving food for heating, a door to the chamber, the door being normally closed thereby providing for closure of the chamber in which the heating is effected, means of regular operating for generating heat in the chamber or in food in the chamber, a support in the chamber for locating the food in the chamber, and an indicator for signalling the existence of food in the chamber, comprising means for having the indicator be operational after the regular operation of the means for generating heat in the chamber or in the food, and when the heat-generating means is non-operating including sensor means having a beam signalling source and receiver, and wherein interference in the beam indicates the existence of food in the oven.

10. Apparatus for preventing the spoilage of food in a microwave oven, in combination with a microwave oven which includes a chamber within which there are means for receiving food for heating, a door to the chamber, the door being normally closed thereby providing for closure of the chamber in which the heating is effected, a microwave generator for generating heat in food in the chamber, a support in the chamber for locating the food in the chamber, comprising a sensor for sensing the existence of food located on the support and an indicator for signalling the existence of food in the chamber when the microwave generator for generating heat in the food is non-operating, the indicator operating independently of closure of the door.

11. Apparatus for preventing the spoilage of food in a microwave oven, in combination with a microwave oven which includes a chamber within which there are means for receiving food for heating, a door to the chamber, the door being normally closed thereby providing for closure of the chamber in which the heating is effected, a microwave generator for regular operation for generating heat in food in the chamber, an indicator for signalling the existence of food in the chamber, the indicator being selectively at least one of light means or audio means, and a sensor, the sensor being sensitive to weight, and wherein a weight greater than a predetermined amount indicative of food in the chamber activates the indicator, the indicator being operational when the microwave generator for generating heat on the food is non-operating, the indicator operating independently of closure of the door.

12. Apparatus for preventing the spoilage of food in an oven in combination with an oven which includes a chamber within which there are means for receiving food for heating, a door to the chamber, the door being normally closed, thereby providing for closure of the chamber in which the heating is effected, means for regular operation for generating heat in the chamber, means for locating the food in the chamber, and an indicator for signalling the existence of food in the chamber, comprising a food weight sensor and wherein a weight greater than a predetermined amount activates the indicator and means for having the indicator be operational after the regular operation of the means for generating heat in the chamber or in the food, and when the heat-generating means is not operating, the indicator operating independently of closure of the door.

13. Apparatus as claimed in claim 12, including a timer, the timer acting to delay operation of the indicator for a predetermined time.

* * * * *